United States Patent [19]

Rath

[11] Patent Number: 4,847,532

[45] Date of Patent: Jul. 11, 1989

[54] TENSED SHADOW MASK ASSEMBLY FOR CATHODE-RAY TUBE

[75] Inventor: Dale R. Rath, Gales Creek, Oreg.

[73] Assignee: Tektronix, Inc., Beaverton, Oreg.

[21] Appl. No.: 199,639

[22] Filed: May 27, 1988

[51] Int. Cl.[4] ..... H01J 29/07; H01J 9/00

[52] U.S. Cl. ..... 313/407; 313/408; 445/30

[58] Field of Search ..... 313/407, 408, 402; 445/30, 37, 45

[56] References Cited

U.S. PATENT DOCUMENTS

| | | | |
|---|---|---|---|
| 2,663,821 | 12/1953 | Law | 313/402 X |
| 2,733,366 | 1/1956 | Grimm et al. | 313/408 X |
| 2,951,179 | 8/1960 | Evans | 313/402 X |
| 4,547,696 | 10/1985 | Strauss | 313/407 |
| 4,591,344 | 5/1986 | Palac | 445/30 |
| 4,593,225 | 6/1986 | Dietch et al. | 313/407 |
| 4,595,857 | 6/1986 | Rowe et al. | 313/407 |
| 4,605,879 | 8/1986 | Rath | 313/407 |
| 4,614,892 | 9/1986 | Palac | 313/402 |
| 4,652,791 | 3/1987 | Palac et al. | 313/402 |
| 4,656,389 | 4/1987 | Palac | 313/402 |
| 4,721,879 | 1/1988 | Palac | 313/402 |
| 4,756,702 | 7/1988 | Steiner | 445/30 |

*Primary Examiner*—Palmer C. DeMeo

*Attorney, Agent, or Firm*—John D. Winkelman; Patrick W. Hughey

[57] ABSTRACT

A tensed shadow mask assembly is adapted for repeated precise registration relative to a display screen in order to facilitate processing of the phosphor deposits on the display screen, wherein the registration of the shadow mask relative to the display screen is unaffected by the subsequent permanent sealing of the CRT. A display panel (36) is associated with the CRT faceplate (26) and has an outer edge (38) and a surface that carries a pattern of cathodoluminescent phosphor deposits (44). A rigid band (48) is permanently fastened around the outer edge of the display panel (36). A shadow mask frame (56) having a tensed shadow mask (58) fastened thereto is removably mounted to the band (48). The shadow mask frame (56) and band (48) carry registration mechanisms (70, 72, 76, 78) for orienting the frame (56) at a predetermined position relative to the band (48) (hence, relative to the display panel (36)) whenever the frame (56) is mounted to the band (48). As one aspect of this invention, there is provided a fixture (80) that is attachable to the shadow mask frame (56) and is adapted for mounting and removing the shadow mask frame (56) to and from the band (48).

10 Claims, 3 Drawing Sheets

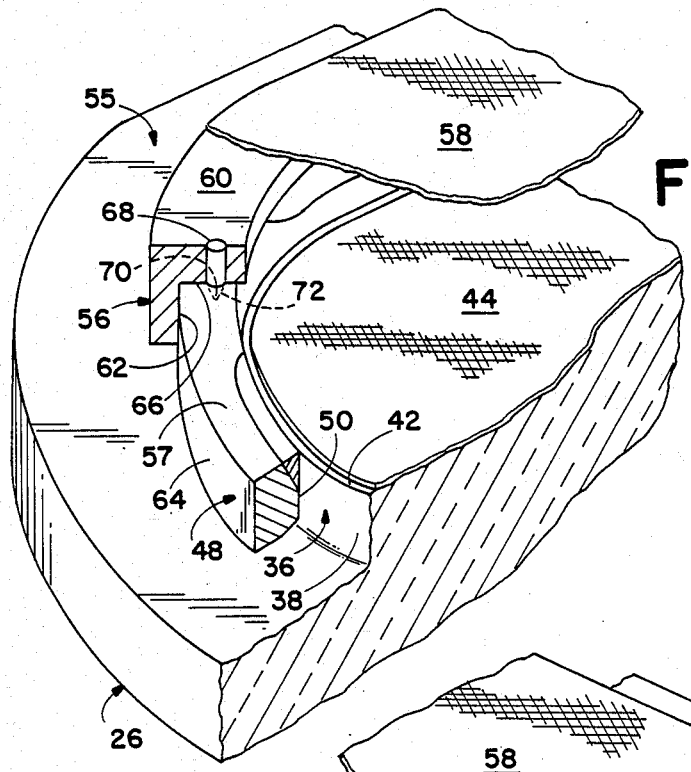
FIG. 4
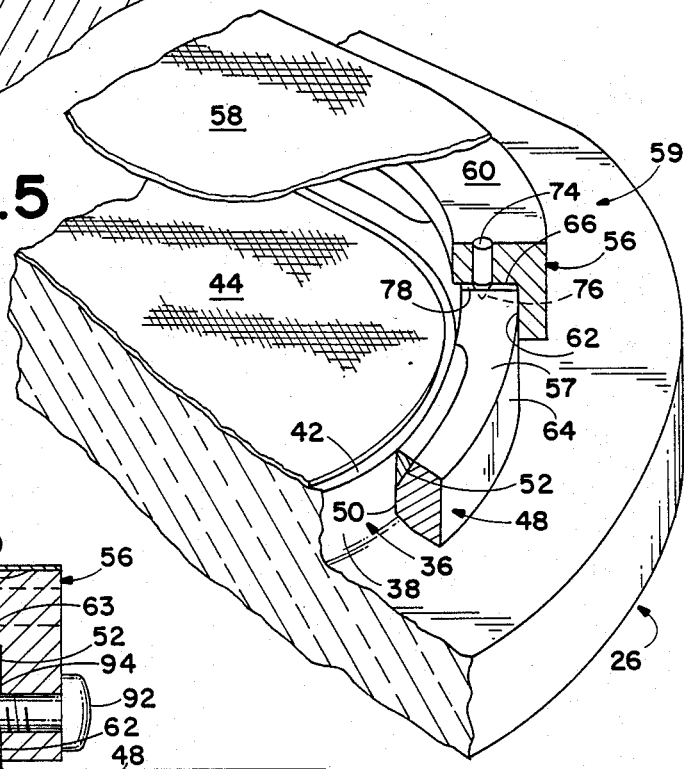
FIG. 5
FIG. 3
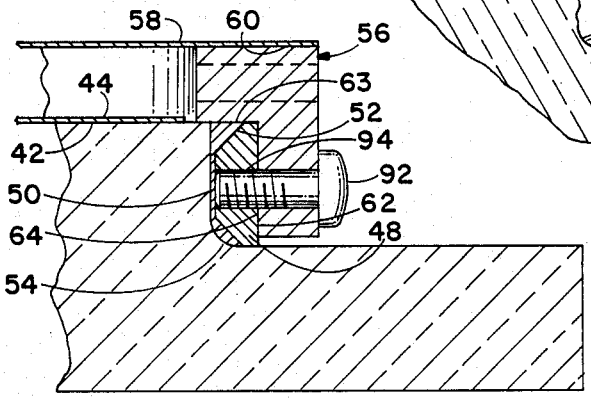

TENSED SHADOW MASK ASSEMBLY FOR CATHODE-RAY TUBE

FIELD OF THE INVENTION

The present invention relates to a tensed shadow mask assembly, and to a method for mounting the assembly adjacent to the faceplate of a cathode-ray tube.

BACKGROUND OF THE INVENTION

A typical color cathode-ray tube (CRT) includes a funnel with an attached faceplate. A cathodoluminescent display screen is carried on the inner surface of the faceplate. The display screen comprises a pattern of discrete phosphor deposits that are arranged in sets of three colors. Three electron guns are mounted within the CRT funnel and aimed toward the display screen. The guns are controlled by an associated scanning system to direct electron beams toward the phosphor deposits. The electron beams strike the phosphor deposits after passing through a shadow mask that is positioned between the electron guns and the phosphor deposits. Each electron gun produces a single electron beam for exciting only one color in each set of phosphor deposits as the beam is swept across the display screen by the scanning system.

A shadow mask is a multi-apertured membrane of electron beam absorbing material. The apertures in the shadow mask have the same shape as the phosphor deposits. The shadow mask is precisely positioned adjacent to the display screen of the CRT, and the apertures are arranged so that an electron beam can strike only one color in each set of phosphor deposits as the beam is swept across the screen. Accordingly, the shadow mask shadows or screens the remaining phosphor deposits from that particular beam.

The shadow mask may be constructed so that it is under tension, or "tensed". A tensed shadow mask resists expansion out of its original plane when the mask is heated by the electron beams.

The pattern of phosphor deposits on the display screen is typically formed by a direct photoprinting process. This process includes coating the display screen with a photosensitive slurry containing phosphor particles of one color, for example, red. Next, the shadow mask is removably mounted adjacent to the display screen, and the coating is exposed to ultraviolet light that is projected through the mask apertures. The light emanates from a source that is located at a position that corresponds to the position later assumed by the electron gun that is used to excite the red phosphor deposits. After the display screen is exposed to ultraviolet light, the shadow mask is removed and the display screen coating is treated to remove the unexposed portions of the photosensitive slurry so that a pattern of red phosphor deposits remains. The above-described photoprinting process steps are then repeated for the remaining two colors of phosphor deposits.

It can be appreciated that during the photoprinting process, the shadow mask serves as a stencil for defining the location of phosphor deposits. Accordingly, the shadow mask must be precisely positioned in the same location relative to the display screen each time the shadow mask is mounted to serve as a stencil for the production of one color of the phosphor deposits. One method of ensuring that the tensed shadow mask is precisely positioned involves anchoring the shadow mask to a frame, and providing the frame with a registration mechanism that cooperates with another registration mechanism on the CRT faceplate. For example, U.S. Pat. No. 4,595,857 discloses a registration mechanism that includes three cavities formed in a peripheral sealing land of the CRT faceplate. Correspondingly located and shaped cavities are formed in a rigid frame to which a tensed shadow mask is affixed. The frame overlies the inner portion of the sealing land with the cavities in the frame facing the cavities in the faceplate. A rigid sphere is seated within each void formed by the three sets of facing cavities. The spheres rest against the cavity walls and secure the shadow mask frame (hence, the shadow mask) in a particular position relative to the display screen during the photoprinting process described above.

The CRT funnel, shadow mask frame, and faceplate are permanently sealed together after the photoprinting process is complete. To seal the funnel, frame, and faceplate, the voids formed by the facing cavities are filled with frit so that the spheres are nested within the frit. The frit is also applied between the outer portion of the sealing land of the faceplate and the CRT funnel surface to which the faceplate is sealed. After the frit is applied, the assembled CRT funnel, faceplate, and shadow mask frame are heated to approximately 430° C. for approximately 45 minutes. During heating, the frit devitrifies. Upon subsequent cooling, the frit seals the CRT funnel, faceplate, and shadow mask frame together.

It has been found that with prior techniques, the registration between the shadow mask and the display screen, which registration may be precisely maintained during processing of the display screen, changes after the CRT is finally sealed. Such changes in the registration between the shadow mask and the display screen may result from an uneven application of frit material, or from small amounts of frit remaining trapped between the spheres and cavity walls that comprise the registration mechanism described above. Any registration change after the photoprinting process will have deleterious effects on the color purity of the CRT because the electron beams will not precisely strike their associated color of phosphor deposits.

It is desirable to provide a shadow mask assembly that is adapted for repeated precise registration relative to a display screen in order to facilitate processing of the phosphor deposits on the display screen, wherein the registration of the shadow mask relative to the display screen is unaffected by the subsequent permanent sealing of the CRT.

SUMMARY OF THE INVENTION

The present invention is directed to a tensed shadow mask assembly that is adapted for repeated, precise registration relative to a display screen in order to facilitate processing of the phosphor deposits on the display screen, wherein the registration of the shadow mask relative to the display screen is unaffected by the subsequent permanent sealing of the CRT. The invention particularly comprises a display panel that has an outer edge and a surface that carries a pattern of cathodoluminescent phosphor deposits. A rigid band is permanently fastened around the outer edge of the display panel. A shadow mask frame having an attached tensed shadow mask is removably mounted to the band. The shadow mask frame and band carry registration mechanisms for orienting the frame in a predetermined position relative to the band (hence, relative to the display panel) whenever the frame is mounted to the band.

As one aspect of this invention, there is provided a fixture that is attachable to the shadow mask frame and adapted for mounting the shadow mask frame to the band.

BRIEF DESCRIPTION OF THE DRAWINGS

FIG. 3 is a cross-sectional view of a portion of the tensed shadow mask assembly.

FIG. 4 is an isometric view, partly in cross-section, depicting one component of a mechanism for registering the shadow mask frame and display panel.

FIG. 5 is an isometric view, partly in cross-section, depicting another component of the mechanism for registering the shadow mask frame and display panel.

DETAILED DESCRIPTION OF PREFERRED EMBODIMENT

Figure 1:
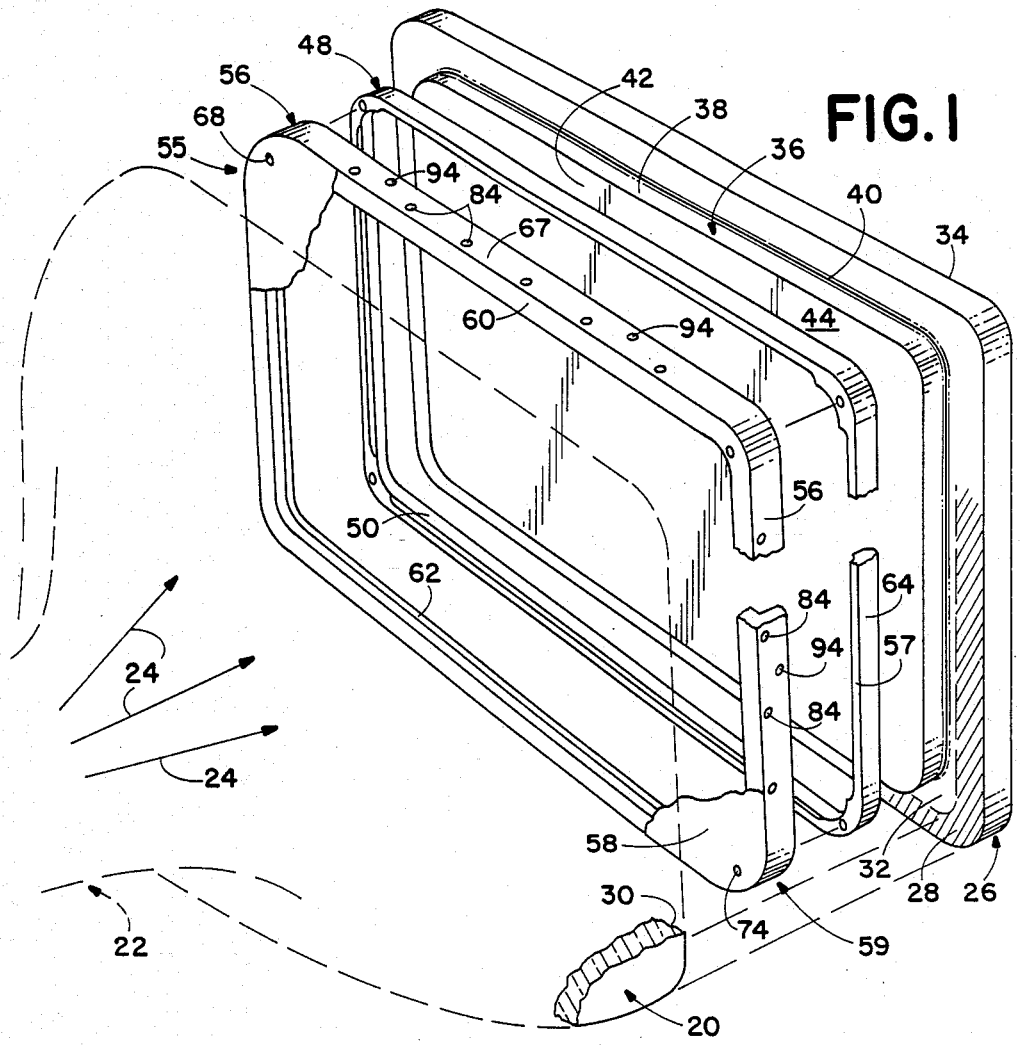
FIG. 1 is an exploded perspective view of the tensed shadow mask assembly of the present invention.

FIG. 1 depicts an isometric exploded view of a tensed shadow mask assembly of the present invention. The assembly is attachable to the display end of a cathode-ray tube (CRT). The CRT comprises a glass funnel 20 having a neck 22 that includes a region that houses three electron guns (not shown). The directions of propagation of the electron beams emanating from the guns are controlled by a conventional scanning system that is operatively associated with the funnel. The electron beams are represented by arrows 24.

The CRT faceplate 26 is a substantially flat transparent glass member having a peripheral sealing land 28 (shown cross-hatched in FIG. 1) that is frit-sealed to a corresponding sealing land 30 that is formed in the forward edge of the funnel 20. In the preferred embodiment, the faceplate 26 is substantially rectangular.

A display panel 36 is integrally formed with the faceplate 26 and protrudes from the inner surface 32 thereof. A raised edge 38 defines the outer periphery of the display panel 36. A small radius 40 is formed where the edge 38 of the display panel 36 joins the inner surface 32 of the faceplate 26. The radius 40 serves to minimize any stress concentration at that junction. The display panel 36 is sized to be completely surrounded by, and spaced from, the funnel sealing land 30 when the funnel and faceplate 26 are sealed together.

The inner surface 42 of the display panel 36 carries a display screen 44 that comprises a multitude of three-color sets of cathodoluminescent phosphor deposits formed in accordance with the photoprinting process mentioned earlier.

With reference to FIGS. 1–5, a continuous metal band 48 is permanently fastened around the edge 38 of the display panel 36. The inner surface 50 of the metal band 48 is chamfered at its top 52 and its bottom 54. The band 48 is frit-sealed to the display panel edge 38. The frit fills a small space between the band 48 and the display panel 36, including the voids formed by the chamfering of the band inner surface 50.

The band 48 provides a means for removably mounting a shadow mask frame 56 in precise registration with the display screen 44 so that an apertured shadow mask 58, which is fastened to the frame 56, may serve as a stencil during the production of the display screen 44 via the photoprinting process mentioned earlier.

The shadow mask frame 56 is L-shaped in cross-section (FIG. 3) and fits around the band 48 that is fastened to the display panel 36. The apertured shadow mask 58 is fastened to the top surface 60 of the frame. The mask 58 is fastened to the frame 56 in a manner that maintains the mask in tension. For example, the mask 58 may be heated and then welded to the frame 56 while the frame is held at room temperature. Upon cooling, the mask 58 contracts and is thereafter tensed.

The tension in the mask 58 is transferred to the frame 56. The frame 56 is sized so that the tension of the mask 58 contracts the frame inwardly so that the frame tightly fits against the band 48. In this regard, the frame 56 has a first flat seating surface 62 that bears tightly against the outer surface 64 of the metal band 48. A second flat seating surface 66 formed in the frame 56 rests upon the top surface 57 of the band 48 and upon an adjacent portion of the inner surface 42 of the display panel 36.

The relative position of the shadow mask frame 56 and band 48 (hence, the registration of the apertured shadow mask 58 and the display screen 44) is fixed by a registration mechanism now described with particular reference to FIGS. 4 and 5. At one corner 55 of the frame 56, a rigid pin 68 is press-fit into a hole formed in the frame 56. The pin 68 has a tapered tip 70 that protrudes from the second seating surface 66 of the frame and mates with a correspondingly shaped registering hole 72 formed in the top surface 57 of the metal band 48. It is noteworthy that in the region of the band 48 surrounding the registering hole 72, no chamfer is formed in the top 52 of the bands interior surface 50.

FIG. 5 depicts the corner 59 of the frame that is diagonally opposed to the corner 55 of the frame that carries the just-described pin 68. The opposing corner 59 has a substantially identical pin 74 press-fit therein. The tapered tip 76 of this pin 74 fits within a slot 78 formed in the top surface 57 of the band 48. The slot 78 extends through the top surface 57 of the band 48 along a line that is substantially normal to the interior surface 50 of the band 48. A slot is preferred (that is, as opposed to another registering hole) in order to accommodate machine tolerances in forming the band 48 and the frame 56.

The registration mechanism just described permits the precise registration of the shadow mask 58 relative to the display screen 44 as the frame 56 is mounted and remounted to the metal band 48 during the photoprinting process. In accordance with this invention, a fixture 80 is provided for mounting, removing and remounting the shadow mask frame 56 to the band 48.

Figure 2:
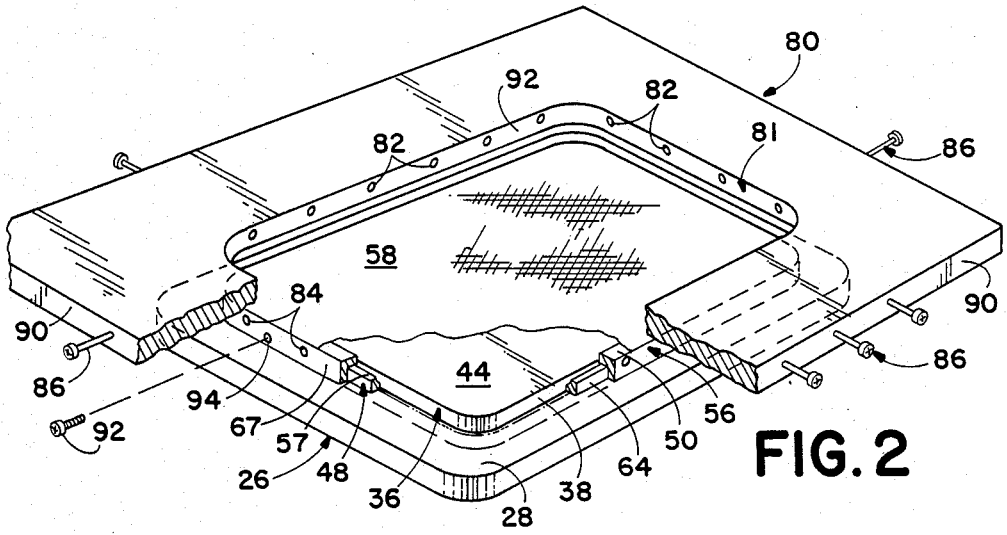
FIG. 2 is an isometric view of the tensed shadow mask frame illustrating a fixture that is adapted for mounting the shadow mask frame to a display panel.
Figures 6, 7, 8:
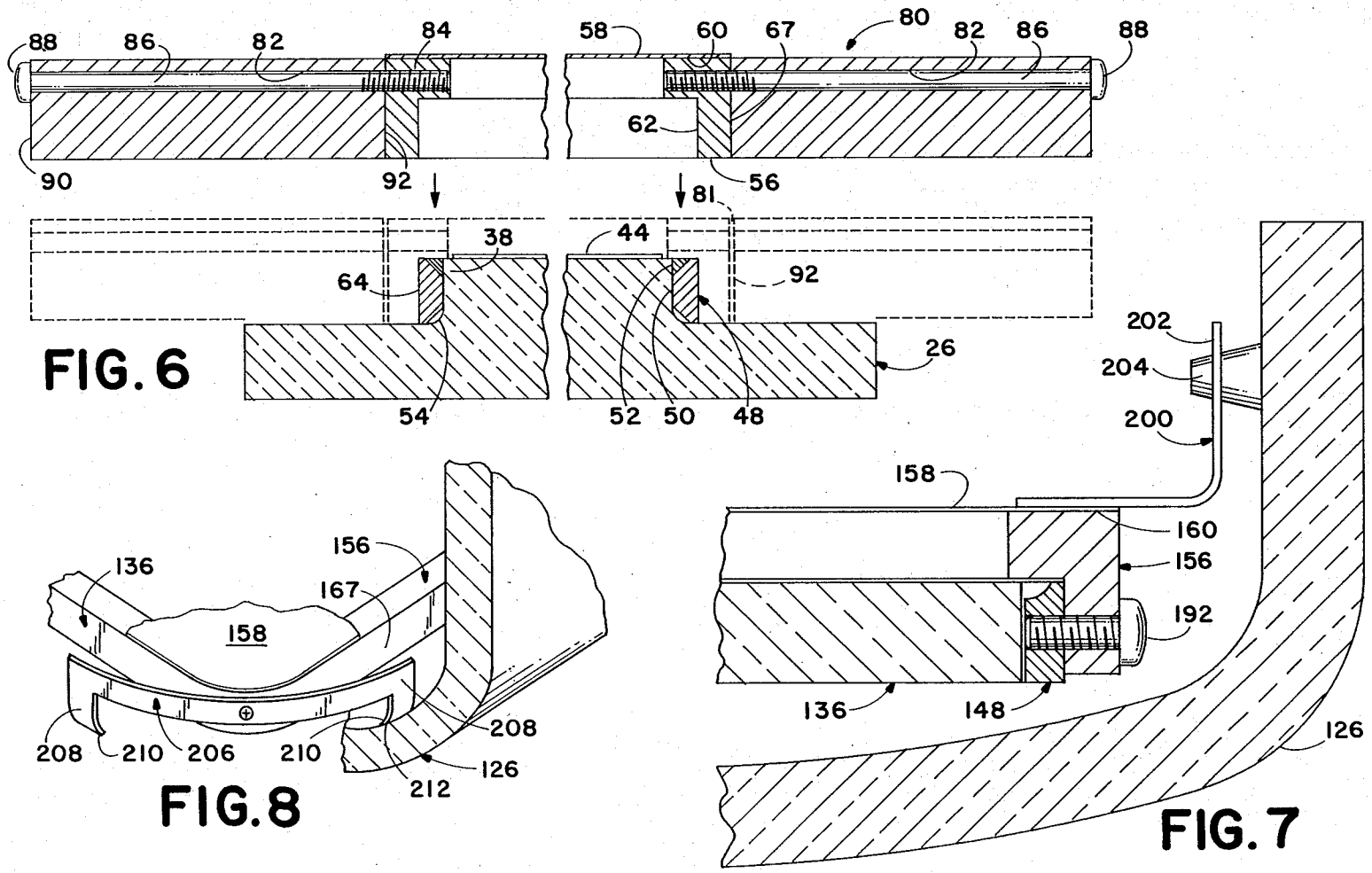
FIG. 6 is a cross-sectional view of the tensed shadow mask assembly illustrating use of the fixture for mounting the shadow mask frame to the display panel.
FIG. 7 is a cross-sectional view of an alternative embodiment of a tensed shadow mask frame assembly wherein the display panel is separate from the CRT faceplate.
FIG. 8 is an isometric view, partly in cross-section, illustrating a corner support bracket for supporting within a CRT the discrete display panel and shadow mask frame of FIG. 7.

With particular reference to FIGS. 2 and 6, the rigid fixture 80 has a generally rectangular shape and completely surrounds the outer surface 67 of the shadow mask frame 56. The area of the central opening 81 of the fixture 80 is slightly larger than the frame 56 so that it may be slightly expanded when secured by the fixture.

The means for securing the frame 56 to the fixture 80 are now described. Six holes 82 are formed through the fixture 80 along each long side of the fixture 80. Four holes 82 are formed through the fixture 80 along each short side of the fixture. Each hole 82 aligns with a threaded hole 84 formed in the shadow mask frame 56. The threaded hole 84 in the shadow mask frame extends between the top surface 60 and the second seating surface 66 of the frame 56. It is contemplated that the quantity and spacing of fixture holes 82 may be other than just specified.

Fixture screws 86 are inserted through the holes 82 in the fixture 80 and threaded into the aligned threaded holes 84 in the shadow mask frame 56. The heads 88 of the fixture screws 86 bear against the outer surface 90 of the fixture. The fixture 80 is substantially more rigid than the shadow mask frame 56 and, consequently, the shadow mask frame expands outwardly to bear against the inner surface 92 of the fixture as the screws 86 are tightened.

When all of the fixture screws 86 are tightened (FIG. 6), the frame 56 is expanded by a sufficient amount to permit it to be slid over the metal band 48. The fixture screws 86 are released, and the frame 56 contracts to securely grip the metal band 48 (as shown in dashed lines, FIG. 6) with the tip 70 of one registration pin 68 seated within its associated hold 72 and the tip 76 of the other pin 74 residing within its corresponding slot 78. Accordingly, the mask 58 is in precise registration with the display screen 44.

To remove the shadow mask frame 56 from precise registration with the display screen 44, the fixture 80 is relocated around the frame 56 and the fixture screws 86 are tightened so that the frame 56 expands to be easily lifted from the metal band 48.

It is noteworthy that the tension in the shadow mask 58 need never be completely carried by the shadow mask frame 56. That is, the shadow mask 58 and frame 56 are initially joined while the shadow mask 56 frame is attached to the fixture 80. Thereafter, a substantial portion of the tension in the mask 58 will always be transferred to either the fixture 80 (FIG. 6), or to the metal band 48 and display panel 36 (FIG. 2). Accordingly, the shadow mask frame 56 need not be sized to withstand all of the tension imparted by the shadow mask 58.

It is also noteworthy that because the frame 56 is supported by the fixture 80 when the mask 58 is welded to the frame 56, the frame and mask will be assembled so that the frame is correctly sized to fit over the metal band 48.

After the display screen processing is complete, the shadow mask frame 56 is remounted to the display panel 36 as described above. Preferably, an apart-spaced pair of anchoring fasteners 92 are passed through the frame 56 on each side thereof to thread into aligned threaded holes 94 formed in the metal band 48. The anchoring fasteners 92 prevent the shadow mask frame 56 from moving relative to the display panel 36 in the event that the CRT is subjected to a strong shock or vibration. It is contemplated that the tension with which the frame 56 grips the metal band 48 may provide adequate shock resistance without the need for the anchoring fasteners 92.

After the shadow mask frame is anchored to the metal band 48, frit is applied to the funnel sealing land 30, and the funnel 20 and faceplate 26 are frit-sealed together by heating and subsequently cooling the CRT in the conventional manner mentioned earlier. It is noted that the registration of the shadow mask 58 relative to the display screen 44 is unaffected by the operation of sealing the faceplate to the funnel.

FIG. 7 depicts an alternative embodiment of a tensed shadow mask assembly formed in accordance with this invention. In this embodiment, the display panel 136 is a discrete rigid glass plate held by spring clips 200 near the CRT faceplate 126. The remaining components of the assembly: metal band 148; shadow mask frame 156; shadow mask 158; and anchoring fasteners 192; are substantially the same as the like-named parts described earlier and will not be further described here. Further, the above-described fixture 80 may be employed for mounting the frame 158 to the metal band 148 of this embodiment On each of the four sides of the shadow mask frame 156, a spring clip 200 is permanently attached to the top 160 of the frame. Although four clips 200 are preferred, more than one clip 200 may be attached to one side of the frame 156, and the clips need not be attached to all four sides of the frame.

As shown in FIG. 7, each spring clip 200 extends outwardly from the shadow mask frame 156 and then bends upwardly to terminate in a flat portion 202 that can be bent inwardly (i.e., toward the shadow mask frame 156) from its normal relaxed position as shown in FIG. 7. A hole is formed in the flat portion 202 of the spring 200. Whenever the display panel 136 and attached shadow mask frame 156 are properly located within the CRT relative to the faceplate 126, an inwardly protruding glass button 204 that is attached to the faceplate will engage the hole in each spring clip 200, thereby securing the display panel 136 with attached shadow mask frame 156 to the faceplate 126.

FIG. 8 depicts a corner brace 206 that is attached to each corner of the shadow mask frame 156 to enhance the stability of the display panel 136 and frame 156 within the CRT. Specifically, the corner brace 206 is an elongate flat piece of spring metal that is tack-welded at its center to the outer surface 167 of the frame corner. The brace 206 bends around the corner, and its outermost ends are normally biased in the direction away from the shadow mask frame 156. The outermost ends 208 include downwardly depending feet 210 that bear upon the curved edge 212 of the CRT faceplate 126. The curve in the feet 210 corresponds to the curve in the edge of the CRT faceplate. Accordingly, a corner brace 206 is especially effective in resisting movement of the display panel 136 toward the plane of the faceplate 126.

As is known in the art, the contrast of the image generated by a CRT can be enhanced by an anti-reflection coating applied to the flat surfaces of the components through which light passes. Preferably, such a coating is applied to the flat surfaces of the faceplate and of the display panel of the present invention. A suitable anti-reflection coating, which remains in place despite high frit-sealing temperatures, is manufactured by Optical Coating Laboratories, Inc. of Santa Rosa, Calif., under the trademark "High Temperature HEA".

While preferred embodiments of the present invention have been described and illustrated, various modifications will be apparent to those skilled in the art. The invention is intended to include all such modifications within the scope of the appended claims.

I claim:

1. A tensed shadow mask assembly for a CRT comprising:

(a) a display panel having an outer edge and a surface that has a pattern of cathodoluminescent elements deposited thereon;

(b) a rigid band fastened around the outer edge of the display panel;

(c) a shadow mask frame having a tensed shadow mask fastened thereto, the frame being removably mounted to the band; and (d) registration means for orienting the frame at a predetermined position relative to the band whenever the frame is mounted to the band.

2. The assembly of claim 1 further including fixture means attachable to the shadow mask frame for mounting and removing the shadow mask frame to and from the band.

3. The assembly of claim 1 wherein the display panel is integrally formed with a CRT faceplate.

4. The assembly of claim 1 wherein the display panel comprises a discrete rigid plate, and further including support means for supporting the display panel within a CRT.

5. The assembly of claim 1 wherein the registration means includes two apart-spaced pins fastened to protrude from the shadow mask frame and two apart-spaced openings formed in the band, each opening arranged to receive the protruding pin.

6. The assembly of claim 1 further including an anti-reflection coating applied to the surface of the display panel, the coating being formulated to remain in place during frit-sealing of a CRT.

7. A method for mounting a tensed shadow mask near a CRT faceplate that is sealed to a CRT funnel comprising the steps of:

(a) forming a display panel having an outer edge and a surface that has a pattern of cathodoluminescent elements deposited thereon;

(b) fastening a band to the outer edge of the display panel;

(c attaching a tensed shadow mask to a frame; and (d) mounting the frame to the band.

8. The method of claim 7 including the step of expanding the frame before mounting the frame to the band.

9. The method of claim 7 including the step of forming registration means in the frame and the band for securing the frame in a predetermined position relative to the display panel surface whenever the frame is mounted to the band.

10. The method of claim 7 including the step of coating the surface of the display panel with an anti-reflection coating that is formulated to remain in place during frit-sealing of a CRT.

* * * * *